US009683779B2

(12) United States Patent
Kataoka et al.

(10) Patent No.: US 9,683,779 B2
(45) Date of Patent: Jun. 20, 2017

(54) INDIRECTLY HEATED ROTARY DRYER

(75) Inventors: Masaki Kataoka, Tokyo (JP); Satoshi Suwa, Tokyo (JP); Keisuke Matsuda, Tokyo (JP)

(73) Assignee: TSUKISHIMA KIKAI CO., LTD, Tokyo (JP)

( * ) Notice: Subject to any disclaimer, the term of this patent is extended or adjusted under 35 U.S.C. 154(b) by 437 days.

(21) Appl. No.: 13/818,716

(22) PCT Filed: Jul. 29, 2011

(86) PCT No.: PCT/JP2011/067407

§ 371 (c)(1),
(2), (4) Date: Mar. 26, 2013

(87) PCT Pub. No.: WO2012/026285

PCT Pub. Date: Mar. 1, 2012

(65) Prior Publication Data

US 2013/0174436 A1 Jul. 11, 2013

(30) Foreign Application Priority Data

Aug. 24, 2010 (JP) ..... 2010-187509

(51) Int. Cl.
*F26B 17/32* (2006.01)
*F26B 11/04* (2006.01)

(52) U.S. Cl.
CPC ..... *F26B 17/32* (2013.01); *F26B 11/0404* (2013.01); *F26B 11/045* (2013.01); (Continued)

(58) Field of Classification Search
CPC ..... F26B 11/0409; F26B 11/0404; F26B 11/0445; F27B 2007/046; F27B 2007/048
See application file for complete search history.

(56) References Cited

U.S. PATENT DOCUMENTS 1,332,137 A * 2/1920 Newhouse ..... 34/109
4,093,505 A * 6/1978 Tsuruta et al. ..... 34/136
(Continued)

FOREIGN PATENT DOCUMENTS

DE 23589 C 6/1896
DE 701070 C 1/1941
(Continued)

OTHER PUBLICATIONS

European Search Report of Patent Application No. 11819750.8 dated Nov. 27, 2014, 6 pages, European Patent Office.

*Primary Examiner* — David J Laux
(74) *Attorney, Agent, or Firm* — Renner, Kenner; Arthur M. Reginelli

(57) ABSTRACT

Provided is an indirectly heated rotary dryer which has achieved enhanced energy-saving performance by reducing heating tubes non-contacting with material to be dried and reducing power required for rotation even when a hold up ratio is increased.

Specifically provided is an indirectly heated rotary dryer having four partition walls extended respectively along a shaft center in an inner space of a rotating shell at angle intervals of 90 degrees in the vertical and horizontal directions. The four partition walls partition the inner space of the rotating shell at a lateral section of the rotating shell into four approximately-sector-shaped small spaces respectively extended along the shaft center. Heating tubes are aligned in the rotating shell in three lines extended respectively in parallel to the shaft center of the rotating shell. The heat tubes heat and dry the material to be dried by supplying heated steam to the heating tubes and performing heat exchange with the material to be dried in the rotating shell.

3 Claims, 11 Drawing Sheets

(52) U.S. Cl.
CPC ..... *F26B 11/0409* (2013.01); *F26B 11/0445* (2013.01); *F26B 2200/02* (2013.01); *F26B 2200/24* (2013.01)

(56) References Cited

U.S. PATENT DOCUMENTS

| | | | | |
|---|---|---|---|---|
| 4,864,942 | A * | 9/1989 | Fochtman et al. | 110/226 |
| 5,330,351 | A * | 7/1994 | Ransom et al. | 432/103 |
| 2011/0041393 | A1 * | 2/2011 | Sugita | C10L 5/00 44/626 |

FOREIGN PATENT DOCUMENTS

| | | | |
|---|---|---|---|
| EP | 0305706 | A2 | 3/1989 |
| EP | 1785684 | A1 | 5/2007 |
| JP | 59-69683 | | 4/1984 |
| JP | 04-007810 | | 1/1992 |
| JP | 2001-091160 | | 4/2001 |
| JP | 2005-016898 | | 1/2005 |

* cited by examiner

INDIRECTLY HEATED ROTARY DRYER

TECHNICAL FIELD

The present invention relates to an indirectly heating rotary dryer, which has achieved enhanced energy saving performance by reducing heating tubes non-contacting with material to be dried and reducing power required for rotation even when a hold up ratio is increased. The invention can be applied especially to an apparatus to dry or cool materials to be processed.

BACKGROUND ART

A steam tube dryer (hereinafter, appropriately called STD as well) being an indirectly heating rotary dryer is provided with a rotating shell of which length is 10 to 30 meters. Drying is performed in the rotating shell with heated steam as external heat for drying during a course where material to be dried, fed from one end side of the rotating shell is discharged from the other end side while the rotating shell is rotated.

Specifically, wet powders or granular powders being material to be dried are dried as being contacted to heated tubes in which steam and the like is fed as a heat medium, and concurrently, the dried material is sequentially moved to a discharge opening owing to rotation of the rotating shell. In this manner, the material to be dried is continuously dried.

Such an indirectly heating rotary dryer can be increased in size and is less expensive than an indirectly heating type disc dryer. In addition, drive operation is easy with less maintenance spots and required power is small. Accordingly, such an indirectly heating rotary dryer has been conventionally used in various fields as an apparatus to dry or cool material to be processed.

In an indirectly heating rotary dryer of the related art illustrated in FIG. 11, a plurality of heating tubes 111 is arranged at the inside of a rotating shell 110 as being in parallel to an shaft center of the rotating shell.

However, an upper limit value of a hold up ratio ((volume of material to be dried retained in the rotating shell)/(inner volume of the rotating shell)) of material H to be dried in the rotating shell is approximately 30% owing to a factor of a position through which the material H to be dried is fed. Accordingly, there are not many heating tubes 111A, which contribute to heating as being contacted to the material H to be dried. The ratio of the heating tubes 111A, which contribute to heating, is on the order of 30% with respect to the total heating tubes 111.

Consequently, the heating tubes 111 have not been effectively utilized in a conventional apparatus owing to existence of the heating tubes 111B, which are not contacted to the material H to be dried, or short contact time of the heating tubes being close to a shaft center of the rotating shell even though they are heating tubes 111A, which are contacted to the material.

Further, since the upper limit value of the hold up ratio of material to be dried is approximately 30% as described above, the heating tubes are rarely contacted to the material to be dried even when being arranged in the vicinity of the center in the rotating shell. Accordingly, in the conventional apparatus, heating tubes are not arranged in the vicinity of the shaft center of the rotating shell, thereby resulting in being inefficient and non-economical.

On the other hand, it has been evaluated to increase the hold up ratio of material to be dried in order to increase a contact area between the material to be dried and the heating tubes. However, this case results in causing a power increase for lifting the material to be dried within the rotating shell. Accordingly, the above has been also non-economical with low energy efficiency.

CITATION LIST

Patent Literature

Patent Literature 1: Japanese Patent Application Laid-Open (JP-A) No. 2001-91160
Patent Literature 2: JP-A No. 59-69683
Patent Literature 3: JP-A No. 4-7810
Patent Literature 4: JP-A No. 2005-16898

SUMMARY OF INVENTION

Technical Problem

Meanwhile, some of direct type rotary drying apparatuses or direct type rotary cooling apparatus disclosed in Patent Documents to dry or cool material to be processed by way of directly supplying heated air or cooled air to a rotating shell, which is rotatable about a shaft center, have been provided with partition walls, which partition the inside of the rotating shell to be approximately sector-shaped segments.

However, since haD (ha: volumetric coefficient of heat transfer, D: inner diameter of the rotary drying apparatus and the like) denoting drying capability or cooling capability is constant in the rotary drying apparatus and the like described above, it has been targeted to improve a heat-transfer efficiency by increasing ha while lessening D in accordance with arranging the partition walls in the rotating shell. Therefore, the above has little relation with an indirectly heating rotary dryer of this application.

In view of the above facts, it is an object of the present invention to provide an indirectly heating rotary dryer, which has achieved enhanced energy saving performance by reducing heating tubes non-contacting with material to be dried and reducing power for rotation even when a hold up ratio is increased.

Solution to Problem

An indirectly heating rotary dryer according to the present invention includes a rotating shell, which is rotated about a shaft center thereof, and which is capable of feeding of a material to be dried from one end side thereof and discharge of the dried material from the other end side thereof, a plurality of heating tubes, which heat the material to be dried in the rotating shell as being arranged respectively in the rotating shell in parallel to the shaft center of the rotating shell, and a plurality of partition walls, which are arranged in the rotating shell so as to partition an inner space of the rotating shell into a plurality of small spaces respectively extended along the shaft center of the rotating shell.

In the following, operation of the indirectly heating rotary dryer according to the present invention will be described.

In the indirectly heating rotary dryer of the present invention, the material to be dried is fed from one end side of the rotating shell, which is rotated about the shaft center, and the dried material is discharged from the other end side of the rotating shell. During that time, the plurality of heating tubes arranged respectively in the rotating shell as being in parallel to the shaft center of the rotating shell, heats the material to be dried in the rotating shell. Here, in the present invention, in accordance with arrangement of the plurality of partition walls in the rotating shell, owing to these partition walls, the indirectly heating rotary dryer has a structure where the inner space of the rotating shell is partitioned into the plurality of small spaces respectively extended along the shaft center of the rotating shell.

With the structure where the inside of the rotating shell is partitioned by arranging the plurality of partition walls, the material to be dried can be supplied into the rotating shell as being distributed into the respective small spaces. As a result, a hold up ratio of the material to be dried can be increased and effective usage of the heating tubes can be achieved while more heating tubes are to be contacted to the material to be dried. Meanwhile, in a case of processing the same amount of material to be dried, the rotating shell can be downsized and cost reduction of the indirectly heating rotary dryer can be achieved.

Further, since the material to be dried is supplied as being distributed into the respective small spaces, the material to be dried is moved only within each small space even when the hold up ratio is increased. Therefore, power to lift the material to be dried in the rotating shell is reduced and weight of the material to be dried in the respective small spaces is balanced. Accordingly, power required to rotate the rotating shell can be reduced.

Thus, the present invention provides an indirectly heating rotary dryer having a high economic efficiency with an achievement of enhanced energy saving performance by lessening power even when a hold up ratio is increased as well as reducing the heating tubes, which are not contacted to the material to be dried as increasing the hold up ratio.

Further, an indirectly heating rotary dryer according to the present invention includes a feed unit, which feeds the material to be dried into the rotating shell, and a cylindrical center cover, which is arranged in the vicinity of the shaft center of the rotating shell, having a size corresponding to a seal portion to seal a clearance between the feed unit and the rotating shell, and the respective partition walls connect an outer circumferential face of the center cover and an inner circumferential face of the rotating shell.

Although arrangement of the heating tubes in the vicinity of the shaft center of the rotating shell contributes to an increase of the heat-transfer area, such heating tubes interfere with the feed unit, which feeds the material to be dried into the rotating shell. Accordingly, it is required to prevent the heating tubes from interfering with the feed unit, for example, by bending the heating tubes in the vicinity of the feed unit. As a result, there is a fear to cause a cost increase for manufacturing the indirectly heating rotary dryer.

In contrast, according to the present invention, in addition to simply arranging the partition walls, the center cover having a size corresponding to the seal portion, which seals the clearance between the feed unit and the rotating shell, is arranged in the vicinity of the shaft center of the rotating shell. Further, the partition walls are structured to connect the outer circumferential face of the center cover and the inner circumferential face of the rotating shell, so that a lateral section of each small space is to be a closed shape as being approximately sector-shaped. As a result, the contact efficiency can be improved as reducing a dead space where the heating tubes in the respective small spaces and the material to be dried are not contacted, without need for a complicated structure, such as the heating tubes being bent in the vicinity of the feed unit. Additionally, it becomes possible to further reduce costs for manufacturing the indirectly heating rotary dryer owing to unnecessity for arrangement to prevent the heating tubes from interfering with the feed unit.

Further, in an indirectly heating rotary dryer according to the present invention, the center cover is extended to the vicinity of the feed unit, which feeds the material to be dried into the rotating shell, a screw-shaped blade, which reaches the inner circumferential face of the rotating shell, is arranged at the outer circumferential face of the extended center cover, and a cutout portion is formed so as to eliminate a portion of the center cover at a part where the screw-shaped blade is arranged.

That is, the cutout portion is arranged so as to eliminate the portion of the center cover at the part where the screw-shaped blade is arranged, and the material to be dried is supplied into each partitioned small space via the cutout portion while being fed toward the innermost of the small space owing to rotation of the screw-shaped blade in association with rotation of the rotating shell. Accordingly, the material to be dried enters into the respective small spaces approximately evenly in accordance with rotation of the rotating shell.

Further, in an indirectly heating rotary dryer according to the present invention, the heating tubes are arranged apart from the shaft center of the rotating shell by a length being 15% or more of a radius of the rotating shell as being in parallel to the shaft center of the rotating shell.

In an apparatus of the related art, an upper limit of a hold up ratio of a material to be dried is approximately 30% (to a position at approximately 30% of the radius of a rotating shell). Therefore, even when heating tubes are arranged in the vicinity of the center of a rotating shell, their contact with the material to be dried rarely occurs or if occurs, the contact time per a rotation of the rotating shell is short, thereby providing few effects. Accordingly, the heating tubes have not been arranged in the vicinity of the shaft center by 30% or less of the radius of the rotating shell. However, according to the present invention, as described above, the heating tubes can be contacted to the material to be dried even when the tubes are arranged in the vicinity of the shaft center of the rotating shell as long as they are arranged apart from the shaft center of the rotating shell by 15% of the radius of the rotating shell (corresponding to a seal portion, which seals a clearance between the feed unit and the rotating shell). As a result, an efficiency of heating process of the material to be dried can be further promoted.

Further, in an indirectly heating rotary dryer according to the present invention, a heat medium is supplied into the partition walls or the center cover.

According to the present invention, since the heat medium is supplied into the partition walls or the center cover, the material to be dried is heated not only by the heating tubes but also by the partition walls or the center cover. As a result, a heating efficiency is to be improved.

Effects of the Invention

As described above, according to the present invention, it is possible to provide an indirectly heating rotary dryer, which has achieved enhanced energy saving performance by reducing heating tubes non-contacting with material to be dried and reducing power required for rotation even when a hold up ratio is increased.

MODE FOR CARRYING OUT INVENTION

Hereinafter, a first embodiment of an indirectly heating rotary dryer according to the present invention will be described with reference to the drawings.

Figure 1:
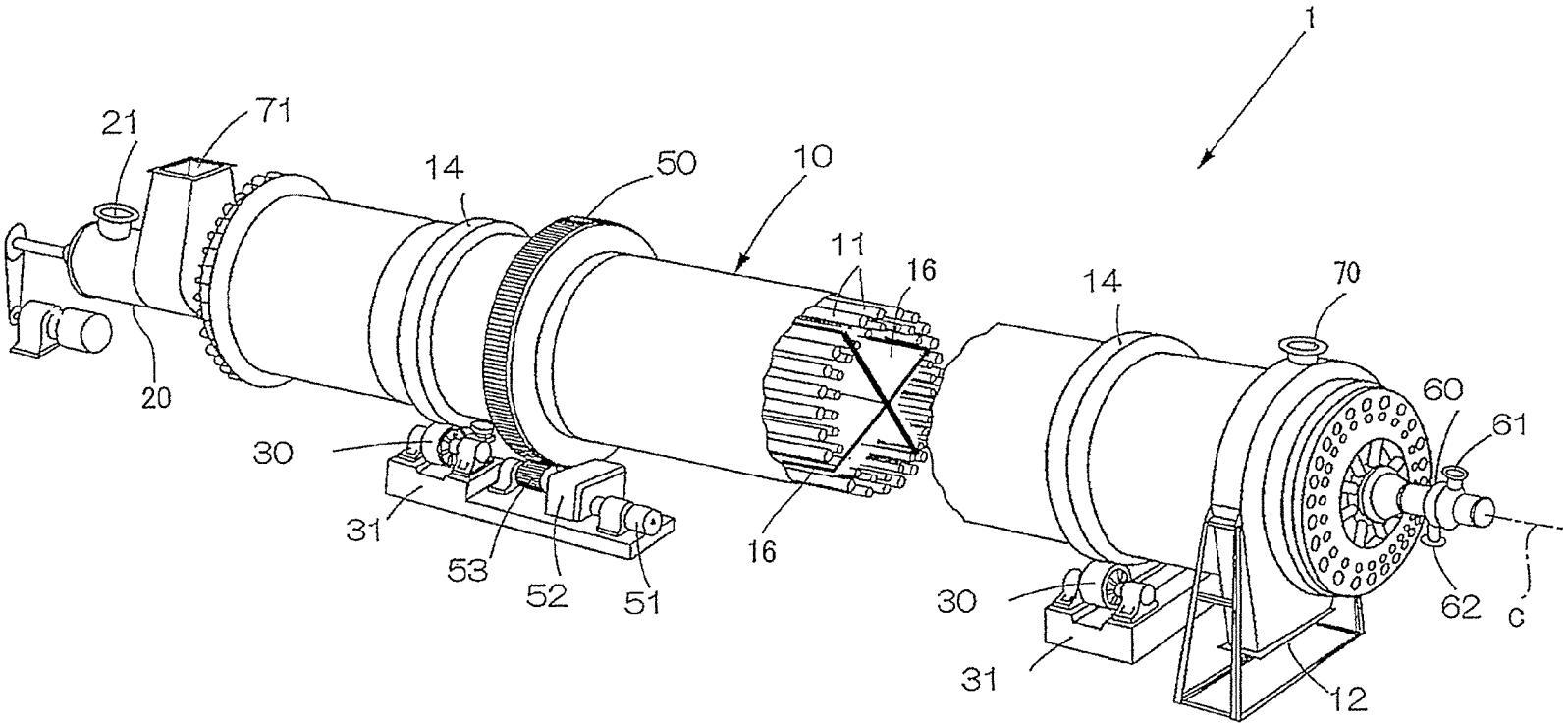
FIG. 1 is a partially-broken perspective view of a rotary heating processing apparatus according to a first embodiment of the present invention.
Figure 2:
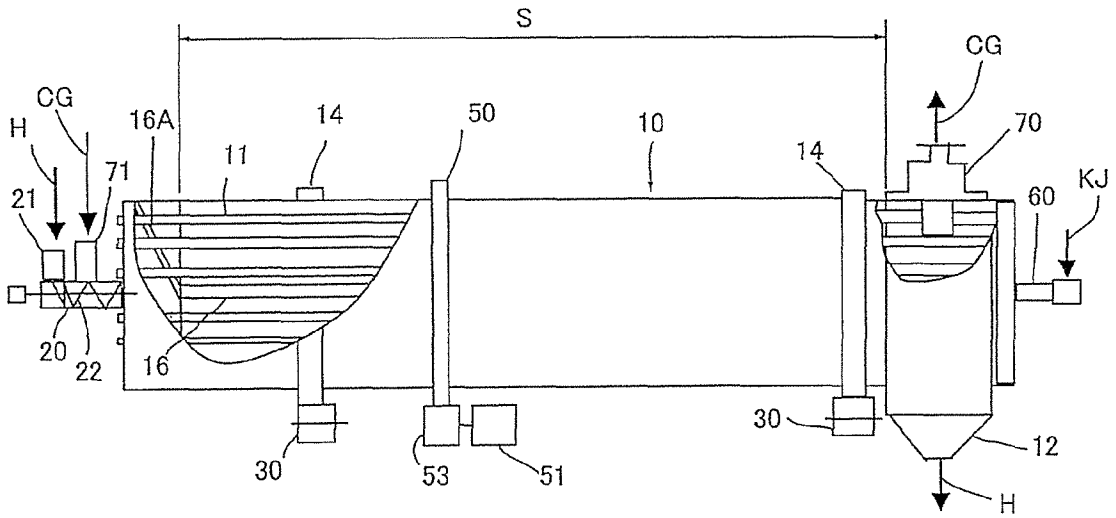
FIG. 2 is a partially-sectioned front view of the rotary heating processing apparatus according to the first embodiment of the present invention.

In advance of a description of the present embodiment, a general structure of the present embodiment will be previously described to enrich understanding, taking the example of the embodiment illustrated in FIGS. 1 and 2 of the indirectly heating rotary dryer, being also called a steam tube dryer, including the present embodiment.

<General Structure of Indirectly Heating Rotary Dryer>

An indirectly heating rotary dryer 1 illustrated in FIGS. 1 and 2 includes a plurality of heating tubes 11 in a rotating shell 10 being rotatable about a shaft center C, as being in parallel to the shaft center between both end plates. The heating tubes 11 are structured so that heated steam KJ as a heat medium is supplied to the heating tubes 11 via a heat medium inlet pipe 61 attached to a rotary joint 60 and that the heated steam KJ is drained via a heat medium outlet pipe 62 after being circulated through the respective heating tubes 11.

Further, the indirectly heating rotary dryer 1 is provided with a feed unit 20, which includes a screw 22 and the like for feeding material H to be dried into the rotating shell 10. Wet powders or granular powders being the material H to be dried poured into the rotating shell 10 from one end side thereof through a feed nozzle 21 of the feed unit 20 are dried as being contacted to the heating tubes 11 which are heated by the heated steam KJ. In addition, owing to an arrangement that the rotating shell 10 is installed to become downward pitch, the dried material H can be continuously discharged from the other end side of the rotating shell 10 as being sequentially and smoothly moved in a direction toward a discharge opening 12.

As illustrated in FIG. 1, the rotating shell 10 is installed on a base 31 and is supported by two pairs of support rollers 30, 30 which are placed as being mutually distanced in parallel to the shaft center C of the rotating shell 10 respectively via a tire 14. A width between the two pairs of support rollers 30, 30 and a slant angle thereof in the longitudinal direction are selected in accordance with the downward pitch and a diameter of the rotating shell 10.

Meanwhile, a driven gear 50 is arranged around the rotating shell 10 to rotate the rotating shell 10. A drive gear 53 is engaged with the driven gear 50 and rotational force of a motor 51 is transmitted via a reducer 52, so that the rotating shell 10 is rotated about the shaft center C via the drive gear 53 and the driven gear 50. Further, carrier gas CG is introduced from a carrier gas inlet 71 to the inside of the rotating shell 10. The carrier gas CG is discharged from a carrier gas outlet 70 as being entrained in steam generated by evaporation of water which is contained in wet powders or granular powders being the material H to be dried.

The abovementioned general structure of the indirectly heating rotary dryer 1 is an example and the present invention is not limited to the above structure.

<Structure of Partition Walls>

Figure 3:
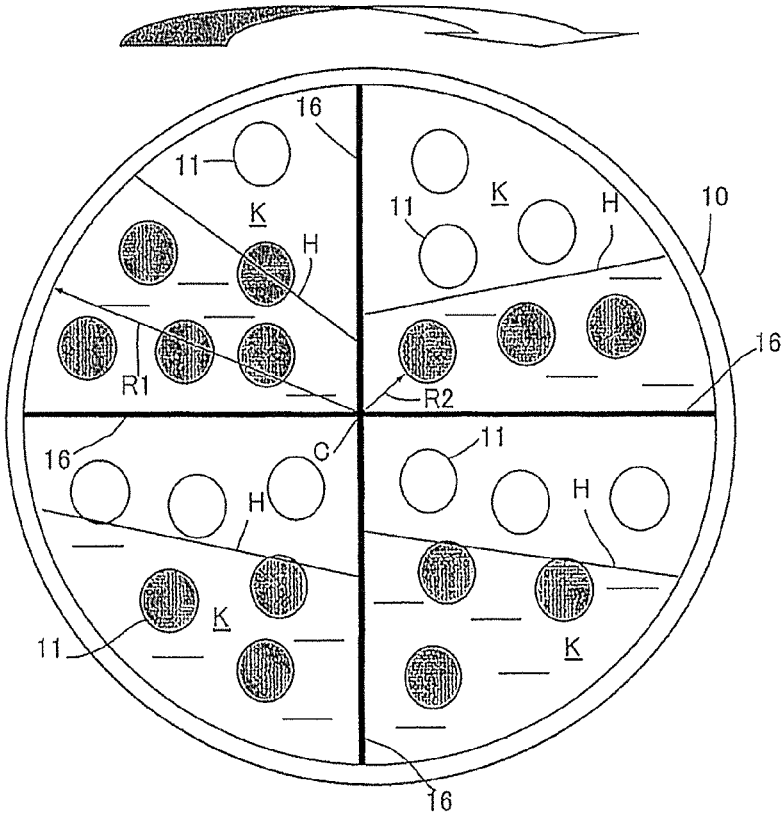
FIG. 3 is a lateral sectional view of a rotating shell, which is applied to the rotary heating processing apparatus according to the first embodiment of the present invention.

As illustrated in FIG. 3, four partition walls 16 being plural extended in an inner space of the rotating shell 10 along the shaft center C are arranged on an inner wall of the rotating shell 10 as respectively intersecting at the shaft center C with equaled angles in a section being perpendicular to the shaft center C of the rotating shell 10. The inner space of the rotating shell 10 is partitioned into four small spaces K being plural respectively extended along the shaft center C respectively having a sector-shaped section being perpendicular to the shaft center C of the rotating shell 10. Here, the partition is performed into four in the present embodiment. However, not limited to the number, it is only required to partition into three or more.

As illustrated in FIG. 2, the respective partition walls 16 are continuously arranged in the shaft direction of the rotating shell 10 in a zone S ranging from the vicinity of the feed unit 20, which feeds material H to be dried, to the vicinity of the discharge opening 12, through which the dried material H is discharged. The respective small spaces K are located at the similar range. Here, it is preferable for supplying the material H to be dried to the respective small spaces K that a blade 16A, which is screw-shaped as in the present embodiment is formed respectively on the partition walls 16 in the vicinity of the feed unit 20.

<Piping Structure of Heating Tubes>

Meanwhile, as illustrated in FIG. 3, the respective heating tubes 11 are arranged as being distributed into the four small spaces K between the endplates at both ends of the rotating shell 10. In the present embodiment, the heating tubes 11 are aligned, for example, in three lines at positions in the rotating shell 10 apart from the shaft center C of the rotating shell 10 at least by length R2, which is 15% or more of a radius R1 of the rotating shell 10, as being extended respectively in parallel to the shaft center C of the rotating shell 10. Then, the heating tubes 11 heat and dry the material H to be dried by supplying the heated steam KJ to the heating tubes 11 as the heat medium and performing heat exchange with the material H to be dried in the rotating shell 10 in accordance with a rotation in a direction of an arrow indicted in FIG. 3.

Next, operation of the indirectly heating rotary dryer 1 according to the present embodiment will be described in the following.

As illustrated in FIGS. 1 and 2, in the indirectly heating rotary dryer 1 of the present embodiment, the feed unit 20 for feeding the material H to be dried into the rotating shell 10 is arranged at one end side of the rotating shell 10. The material H to be dried is fed from the one end side of the rotating shell 10, which is rotatable about the shaft center C, and the dried material H is discharged from the other end side of the rotating shell 10. During that time, the heating tubes 11 arranged respectively in the rotating shell 10 as being in parallel to the shaft center C of the rotating shell 10 heat the material H to be dried in the rotating shell 10.

In the present embodiment, the four partition walls 16 illustrated in FIG. 3 are arranged in the rotating shell 10 and the partition walls 16 are structured to connect the vicinity of the shaft center C of the rotating shell 10 and an inner circumferential side of the rotating shell 10. Accordingly, the indirectly heating rotary dryer 1 has a structure where the inner space of the rotating shell 10 is partitioned into the four small spaces K respectively extended along the shaft center C of the rotating shell 10 by the four partition walls 16 so as to be partitioned into approximate sector shapes at a lateral section of the rotating shell 10.

As described above, with the structure of partitioning the inside of the rotating shell 10 into the four small spaces K by arranging the four partition walls 16, the material H to be dried can be supplied into the rotating shell 10 as being distributed into the respective small spaces K. As a result, a hold up ratio of the material H to be dried can be increased and effective usage of the heating tubes 11 can be achieved while more heating tubes 11 are to be contacted to the material H to be dried. Meanwhile, in a case of processing the same amount of material H to be dried, the rotating shell 10 can be downsized and a cost reduction of the indirectly heating rotary dryer 1 is achieved.

That is, among the heating tubes 11, the heating tubes 11, which contribute to heating, as being contacted to the material H to be dried, can be increased to a proportion of approximately 50% or more, so that drying capability can be improved. Further, as illustrated in FIG. 3, the heating tubes 11 arranged in the vicinity of the shaft center of the rotating shell 10 is to be contacted to the material H to be dried even at an upper part of the rotating shell 10. Accordingly, the heating tubes 11 can be increased even in the indirectly heating rotary dryer 1 having the same size as a conventional apparatus, so that drying capability can be improved as well.

Since the material H to be dried is supplied as being distributed into the respective small spaces K, the material H to be dried is moved only within each small space K even when the hold up ratio is increased. Therefore, power to lift the material H to be dried in the rotating shell 10 is reduced. Further, since the material H to be dried is supplied respectively to the small spaces K, the material H to be dried is present as being distributed at a rotational section of the rotating shell 10 illustrated in FIG. 3. Accordingly, power required to rotate the rotating shell 10 can be reduced.

Owing to the above, in the present embodiment, it is possible to perform operation at a hold up ratio being twice or more of that of a conventional apparatus and to increase a contact area between the heating tubes 11 and the material H to be dried compared to the conventional apparatus. A certain retention time is required owing to the fact that decreasing-rate drying is subject to time when the material H to be dried is dried as including a decreasing-rate drying zone. However, since the hold up ratio can be increased in the present embodiment, it is possible to reduce a size of the indirectly heating rotary dryer 1 at the decreasing-rate drying zone.

Accordingly, the present embodiment provides the indirectly heating rotary dryer 1 having a high economic efficiency with an achievement of enhanced energy saving performance by lessening power even when a hold up ratio is increased as well as reducing the heating tubes 11 which are not contacted to the material H to be dried as increasing the hold up ratio.

Next, a second embodiment of the indirectly heating rotary dryer according to the present invention will be described in the following based on FIGS. 4 and 5. The same numeral is given to the member described in the first embodiment and description thereof will not be repeated.

The indirectly heating rotary dryer 1 according to the present embodiment being structured approximately similarly to the first embodiment is also provided with the heating tubes 11, the four small spaces K partitioned by the four partition walls 16, and the like.

Figure 4:
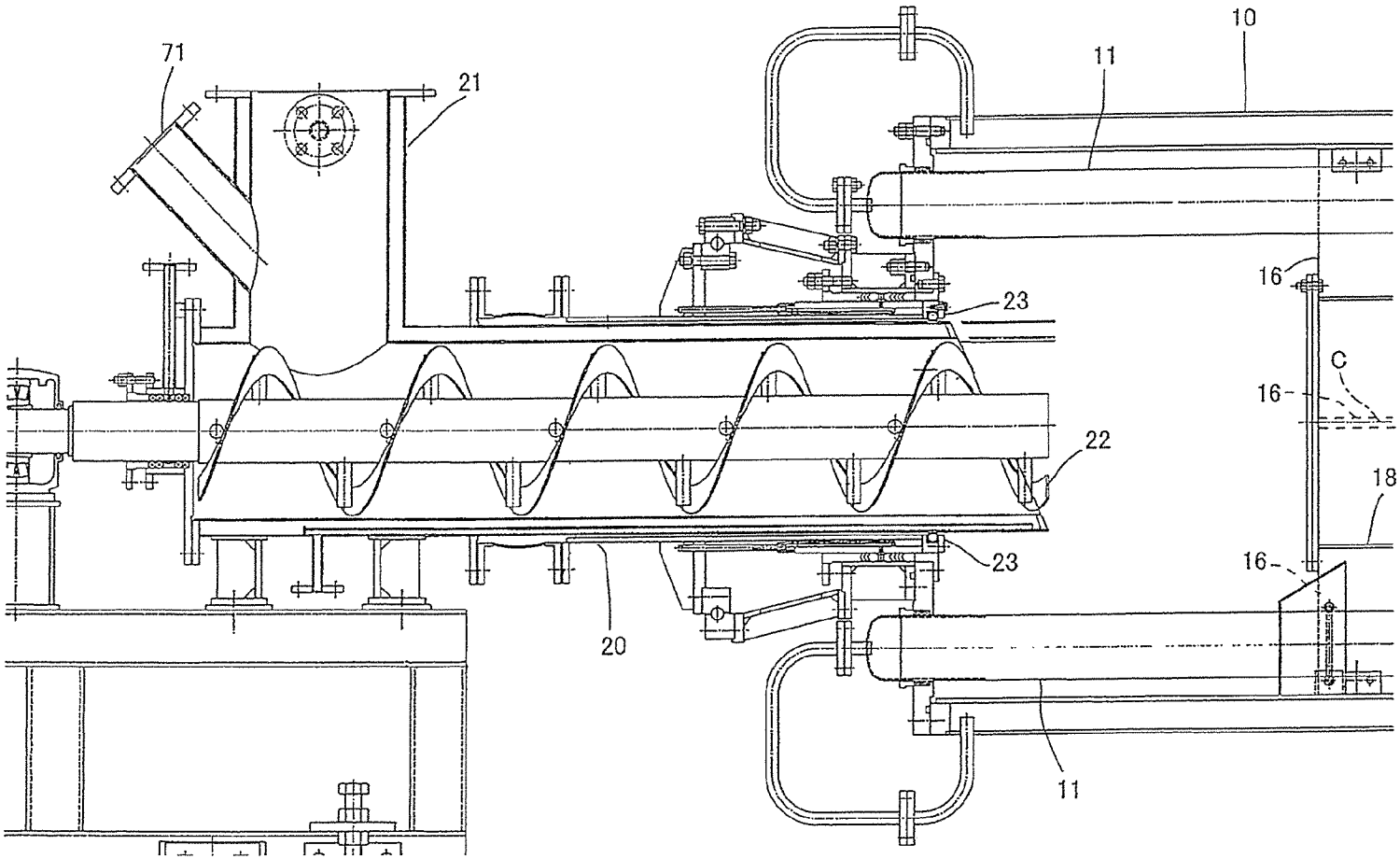
FIG. 4 is a sectional view illustrating a periphery of a feed unit of a rotary heating processing apparatus according to a second embodiment of the present invention.
Figure 5:
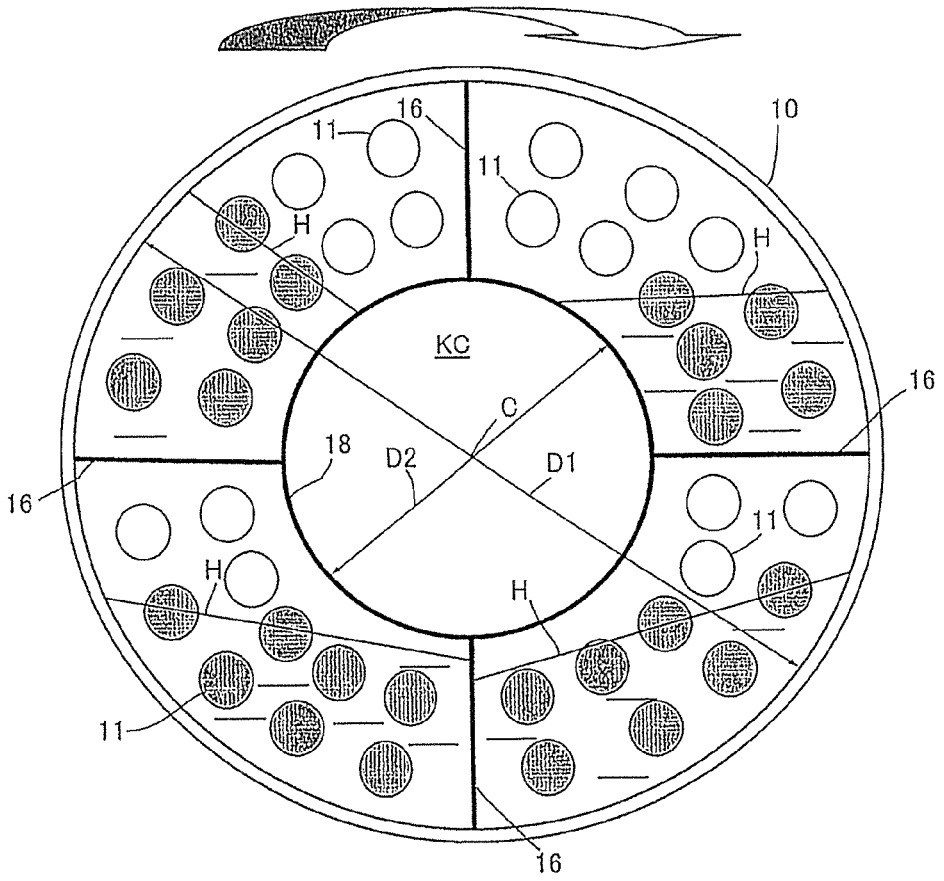
FIG. 5 is a lateral sectional view of a rotating shell, which is applied to a rotary heating processing apparatus according to a third embodiment of the present invention.

However, in the present embodiment, as illustrated in FIG. 4, there are slight differences from the first embodiment in the feed nozzle 21 of the feed unit 20 and the carrier gas inlet 71 in addition to an arrangement of the heating tubes 11.

Here, arranging the heating tubes 11 in the vicinity of the shaft center C of the rotating shell 10 as in the first embodiment contributes to an increase of a contact area between the material H to be dried and the heating tubes 11. However, the heating tubes 11 interfere with the feed unit 20, which feeds the material H to be dried. Accordingly, in the first embodiment, it is required to prevent the heating tubes from interfering with the feed unit 20, for example, by bending the heating tubes 11 in the vicinity of the feed unit 20.

In the present embodiment, there is provided a cylindrically-formed center cover 18 in the vicinity of the shaft center C of the rotating shell 10 having a size corresponding to a seal portion 23 for sealing a clearance between the rotating shell 10 and the feed unit 20, which feeds the material H to be dried into the rotating shell 10. The respective partition walls 16 are structured to connect an outer circumferential face of the center cover 18 and an inner circumferential face of the rotating shell 10.

Therefore, according to the present embodiment, in addition to simply arranging the partition walls 16, the center cover 18 of which diameter is slightly larger than the seal portion 23 corresponding to the seal portion 23, which seals the clearance between the rotating shell 10 and the feed unit 20, is arranged in the vicinity of the shaft center C of the rotating shell 10. In accordance therewith, the partition walls 16 are structured to connect the outer circumferential face of the center cover 18 and the inner circumferential face of the rotating shell 10, so that a lateral section of each small space K is to be a closed shape as being approximately sector-shaped.

By arranging the center cover 18 as described above, the material H to be dried can be prevented from being present in the vicinity of the shaft center C in the rotating shell 10 where the heating tubes 11 are not arranged. Accordingly, opportunity of contacting with the heating tubes 11 is increased for the material H to be dried.

Next, a third embodiment of the indirectly heating rotary dryer according to the present invention will be described in the following based on FIGS. 6 and 7. The same numeral is given to the member described in the first embodiment and description thereof will not be repeated.

In the present embodiment, in addition to forming the center cover 18, the center cover 18 is structured to be extended to the vicinity of the feed unit 20, which feeds the material H to be dried into the rotating shell 10.

Figure 6:
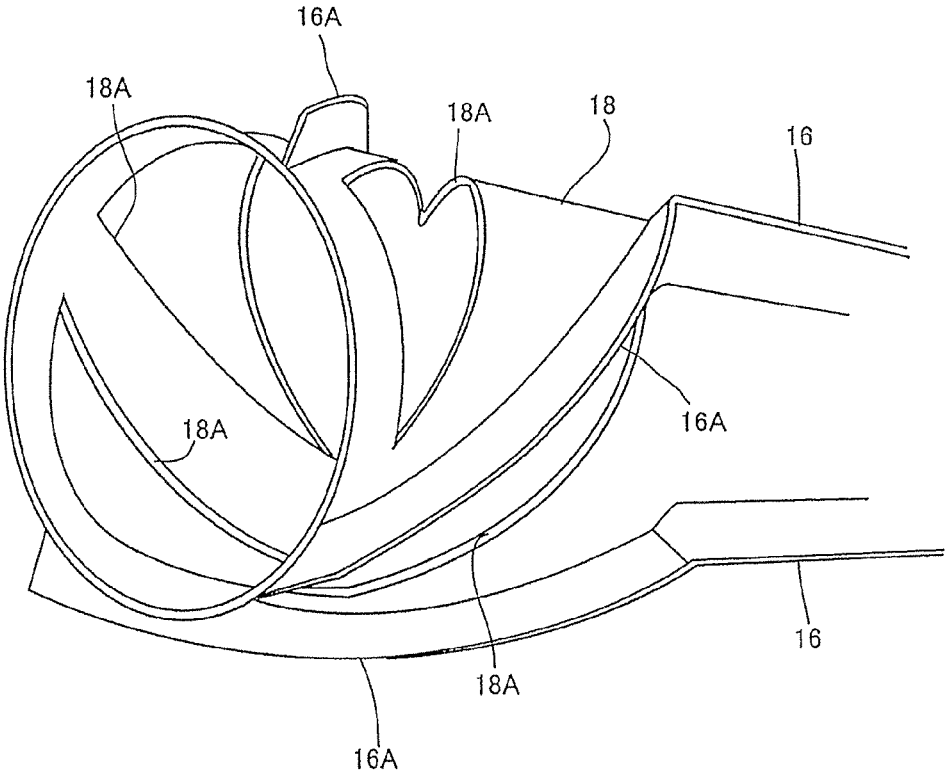
FIG. 6 is a perspective view closer to one end side of a center cover, which is applied to the rotary heating processing apparatus according to the third embodiment of the present invention.
Figure 7:
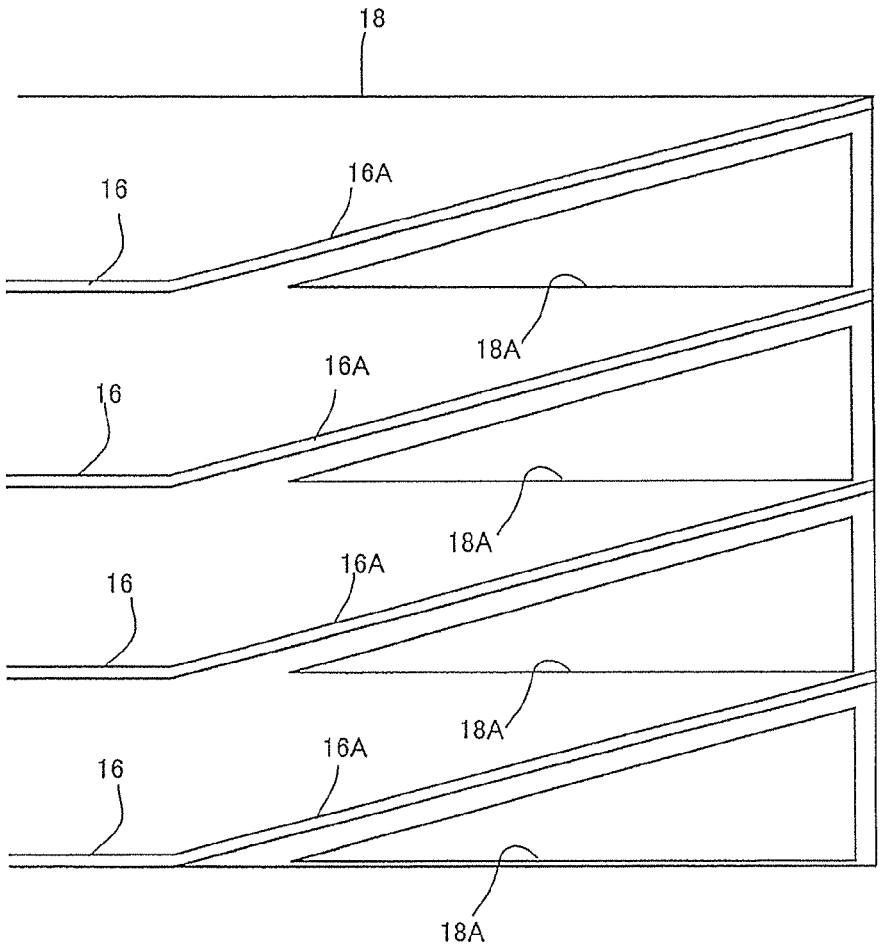
FIG. 7 is a developed view closer to the one end side of the center cover, which is applied to the rotary heating processing apparatus according to the third embodiment of the present invention.

As illustrated in FIG. 6, screw-shaped blades 16A, which reach the inner circumferential face of the rotating shell 10 as being connected respectively to end parts of the partition walls 16, are simply arranged on an extended portion of the center cover 18 at the outer circumferential face side. In addition thereto, cutout portions 18A are also formed by eliminating portions of the center cover 18 into a triangle shape at the parts where the screw-shaped blades 16A are arranged respectively in FIG. 7.

Thus, the present embodiment includes the cutout portions 18A as eliminated portions of the center cover 18 at the parts where the screw-shaped blades 16A are arranged. Accordingly, the material H to be dried fed into the rotating shell 10 from the feed unit 20 is supplied into the respective partitioned small spaces K via the cutout portions 18A in accordance with a rotation of the rotating shell 10. Further, the material H to be dried is distributed to the respective small spaces K approximately evenly by being fed toward the innermost of each small space K owing to a rotation of the screw-shaped blades 16A in association with the rotation of the rotating shell 10.

When the hold up ratio of the material H to be dried is increased as in the present embodiment, there is a possibility that hold up is performed at a position of which height is equal to or higher than a supplying position of the material H to be dried in the feed unit 20, which serves to feed the material H to be dried into the rotating shell 10. Here, since the screw-shaped blades 16A, which feed the material H to be dried, are arranged on the rotating shell 10 in the vicinity of the feed unit 20, the material H to be dried is mandatorily fed by the blades 16A into the small spaces K, which are partitioned into approximate sector shapes.

Figure 8:
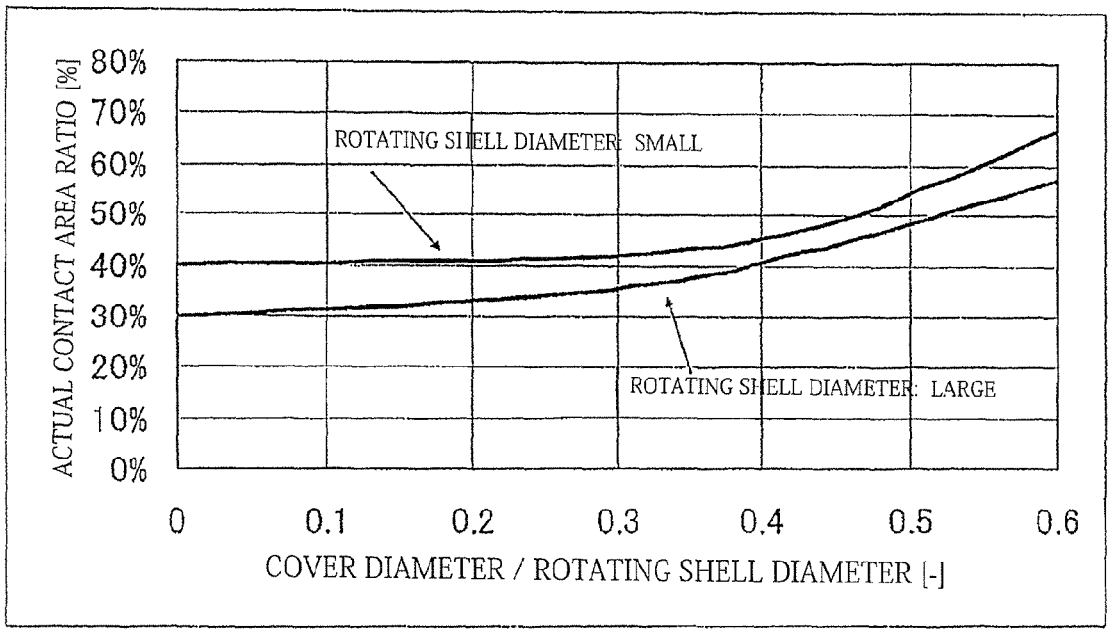
FIG. 8 is a view illustrating a graph, which indicates a relation between a ratio of an outer diameter of the center cover with respect to an inner diameter of a rotating shell and an actual contact area ratio in the rotary heating processing apparatus according to the third embodiment of the present invention.

Here, depending on the diameter of the rotating shell 10 and an arrangement of the heating tubes 11, FIG. 8 indicates a relation between a ratio of an outer diameter D2 of the center cover 18 with respect to an inner diameter D1 of the rotating shell 10 (i.e., the cover diameter/the rotating shell diameter) and an actual contact area ratio under a condition that the hold up ratio is constant. Among two lines of data, the upper data indicates a case that the rotating shell diameter is 965 mm (the rotating shell diameter is small) and the lower data indicates a case that the rotating shell diameter is 3050 mm (the rotating shell diameter is large).

As illustrated by the graph of FIG. 8, the actual contact area between the heating tubes 11 and the material H to be dried is increased with the above increase. However, when the ratio of the outer diameter D2 of the center cover 18 with respect to the inner diameter D1 of the rotating shell 10 exceeds 0.6, drying capability is decreased owing to a fact that a space through which the carrier gas CG passes is lessened and that an agitating effect is decreased.

On the other hand, when the ratio of the outer diameter D2 of the center cover 18 with respect to the inner diameter D1 of the rotating shell 10 falls below 0.2, the outer diameter D of the center cover 18 becomes smaller than an outer diameter of the feed unit 20 in most cases. In such a case, it is required to structure the heating tubes 11 so as not to interfere with the feed unit 20, in order to arrange the heating tubes 11 in the vicinity of the outer diameter of the center cover 18. Such a structure is to be a factor of an increased cost.

Accordingly, in view of an economic aspect and drying capability, the ratio of the outer diameter D2 of the center cover 18 with respect to the inner diameter D1 of the rotating shell 10 is preferably in a range between 0.2 and 0.6.

Meanwhile, it is also possible to supply heated steam KJ being the heat medium to a space KC in the partition walls 16 or the center cover 18 used in the above embodiment. When the heated steam KJ is supplied in the partition walls 16 or the center cover 18, the material H to be dried is heated not only by the heating tubes 11 but also by the partition walls 16 or the center cover 18. As a result, a heating efficiency is further improved. In order to supply the heated steam KJ in the partition walls 16, it is simply enough to form an inner space in the partition walls by arranging a plurality of plates as being opposed with a certain distance or a plurality of pipes as being in parallel.

EXAMPLES

Next, following is description of a comparison test between an example based on the above embodiment and a conventional example performed by using a batch testing machine of an indirectly heating rotary dryer.

First, specifications of the batch testing machine of an indirectly heating rotary dryer are as indicated below.

Rotating shell diameter: 320 mm

Rotating shell length: 0.25 m

Heating tube heat-transfer area: 0.3 $m^2$

Further, test conditions are as indicated below. Materials to be dried: sewage sludge having approximately 30% moisture content Processing rate: approximately 3 kg/h of batch Outlet moisture content target value: 10%

Carrier gas: 5 $m^3N/h$ of normal temperature air

Heated steam: 0.1 MPa (G) of saturated steam

Rotating peripheral speed: 0.5 m/s

Number of small spaces in the example: 4

Figure 9:
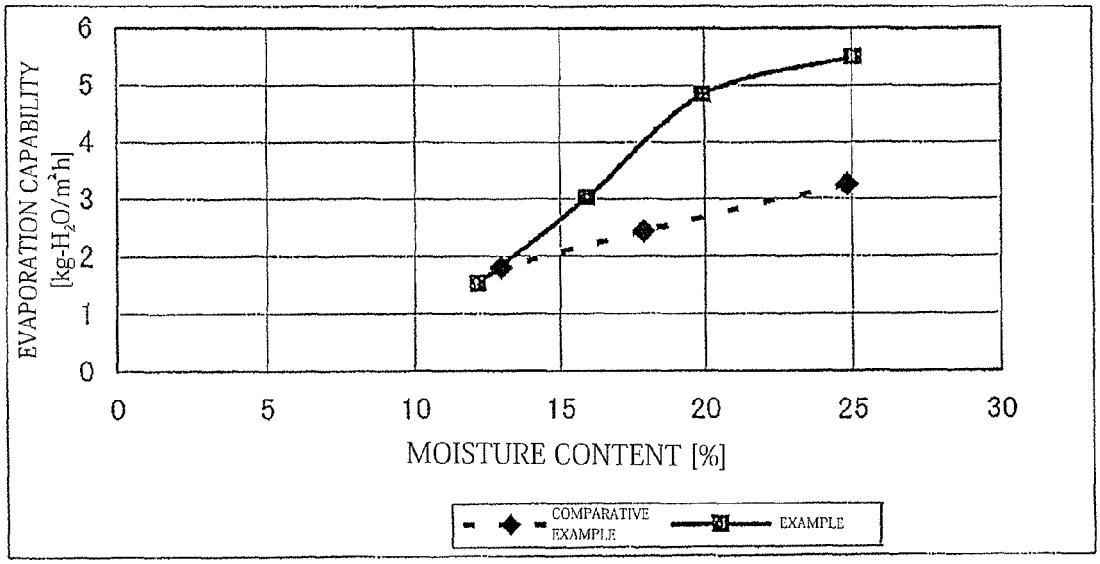
FIG. 9 is a view illustrating a graph, which indicates a relation between a moisture content and evaporation capability.

FIG. 9 is a graph indicating the results of capability of drying moisture in the material to be dried with the example and a comparative example being the conventional example. According to the graph, although difference between the both was small at a low moisture zone (a decreasing-rate drying zone), it is confirmed that improvement in evaporation capability (kg-$H_2O/m^2h$) per unit time was clearly obtained with the example at a high moisture zone (a constant-rate drying zone) owing to difference in unit heating area.

Next, following is description of a test performed by using a continuous processing machine of an indirectly heating rotary dryer.

Comparison of drying capability for drying the same material to be dried was performed between an example and a comparative example being a conventional example having the mutually same main dimensions.

First, operational conditions of the example and the comparative example are as indicated below.

Inlet moisture content of material to be dried: 33%

Mean particle diameter of material to be dried: 2.3 mm

Outlet moisture content of material to be dried: 10%

Heating source: 0.1 MPa (G) of saturated steam

Carrier gas: Air supplied so as to have exhaust gas dew point to be 80° C.

Specifications of an indirectly heating rotary dryer of the example according to the present invention are as indicated below.

Rotating shell diameter: 965 mm

Rotating shell length: 8 m

Number of approximately sector-shaped small spaces: 4

Heating tube heat-transfer area: 43 $m^2$

Specifications of an indirectly heating rotary dryer of the comparative example according to the related art are as indicated below.

Rotating shell diameter: 965 mm

Rotating shell length: 8 m

Heating tube heat-transfer area: 40 $m^2$

A supplying amount of the material to be dried in the above example was set to be 320 kg/h as being the same as the above comparative example and operation was started under this condition. Then, the supplying amount of the material to be dried in the example was acquired in a state of the outlet moisture content being stabilized at approximately 10%. The result was acquired as follows.

Example

Supplying amount of material to be dried: 470 kg/h

Inlet moisture content: 33.1%

Outlet moisture content: 9.8%

STD idle operation power: 3.11 kW

STD drive power: 3.22 kW

Power increase due to load operation: 0.11 kW

The hold up ratio was calculated on collecting the total amount of the dried material in the indirectly heating rotary dryer after the drying test was completed. The hold up ratio was 57%.

Comparative Example

Supplying amount of material to be dried: 320 kg/h

Inlet moisture content: 33.0%

Outlet moisture content: 9.9%

STD idle operation power: 3.11 kW

STD drive power: 3.46 kW

Power increase due to load operation: 0.35 kW

The hold up ratio was calculated on collecting the total amount of the dried material in the indirectly heating rotary dryer after the drying test was completed. The hold up ratio was 27%.

Consequently, according to the example, the hold up ratio is improved in addition to that the STD operation power and the power increase due to load operation are drastically reduced compared to the comparative example.

Figure 10:
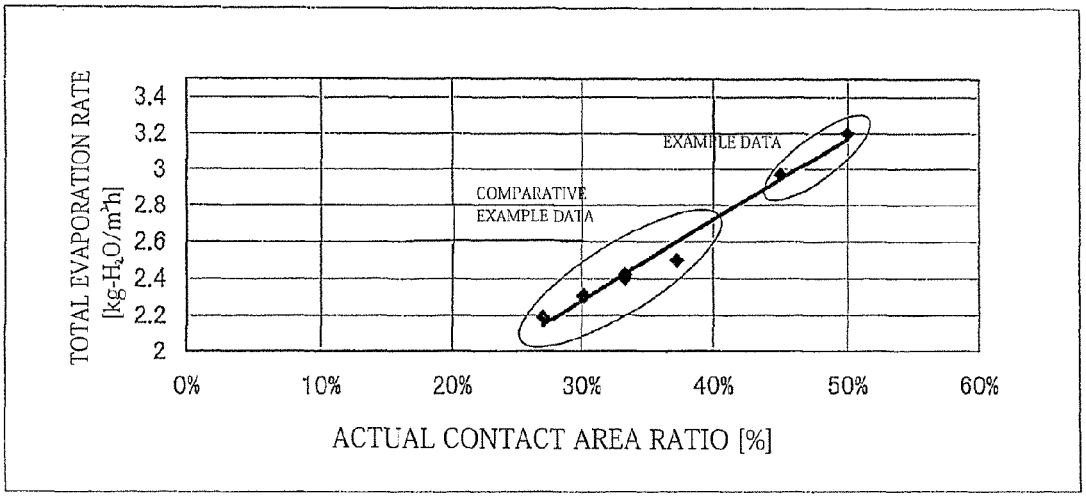
FIG. 10 is a view illustrating a graph, which indicates relation between an actual contact area ratio and total evaporation rate.
Figure 11:
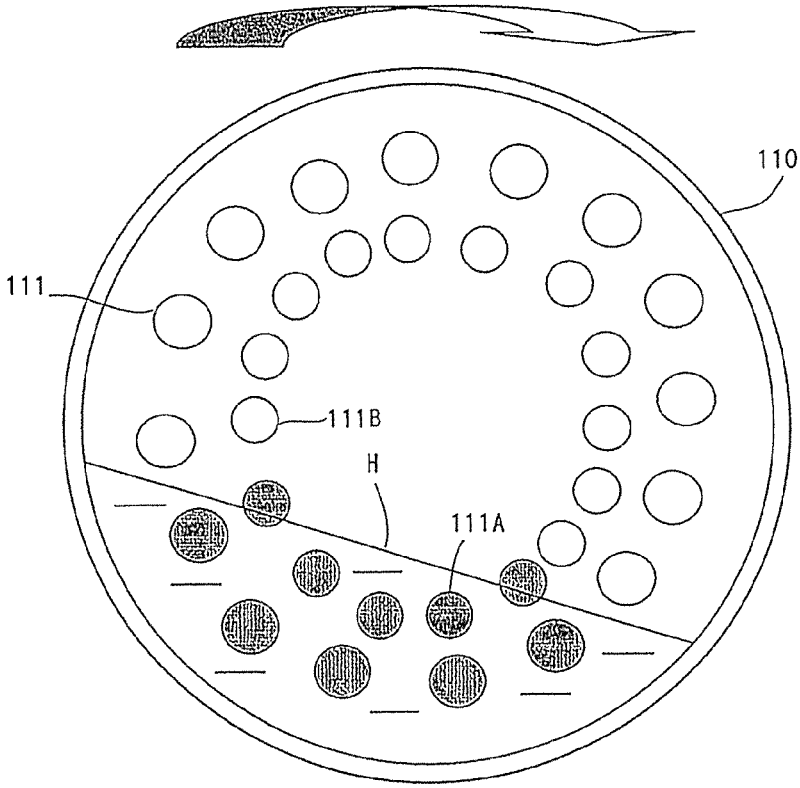
FIG. 11 is a lateral sectional view of a rotating shell, which is applied to a rotary heating processing apparatus of an embodiment in the related art.

Further, a graph of FIG. 10 indicates data when an actual contact area ratio is varied in the example (as varying contact between the material to be dried and the heating tubes) and the comparative example (as measurably varying the hold up ratio). Here, external dimensions of the example and those of the comparative example are the same and the inlet moisture content and the outlet moisture content are approximately the same. According to the graph, it is revealed that drying capability is increased with an increase in a total evaporation rate by increasing contact area between the material to be dried and the heating tubes.

In the graph of FIG. 10, the horizontal axis denotes a ratio of contact area (a ratio of an actual contact area) between actual material to be dried and the heating tubes with respect to the total heating tube area, and the vertical axis denotes evaporation capacity per unit time per unit area of the total heating tubes (total evaporation rate).

As described above, it is proved that the indirectly heating rotary dryer according to the present embodiment is economical as it can reduce required power while drying capacity is increased.

The embodiments of the present invention are described above. However, not limited to the embodiments, the present invention can be actualized as being variously modified without departing from the spirit of the present invention. For example, as for the partition walls 16, which partition the space in the rotating shell 10 into the small spaces K, the number is four in the embodiment but may be 5, 6 or another plural number. When the partition walls 16 are 5, 6 or the like, the number of the small spaces K becomes to be plural as being 5, 6 or the like.

INDUSTRIAL APPLICABILITY

The present invention can be applied to an indirectly heating rotary dryer for drying woody biomass, organic waste and the like including drying resin, food, organic material and the like. In addition, the present invention can be applied to other industrial machines.

REFERENCE SIGNS LIST

1 Indirectly heating rotary dryer
10 Rotating shell
11 Heating tube
16 Partition wall
16A Blade
18 Center cover
18A Cutout portion
20 feed unit
C Shaft center
H Material to be dried
K Small space

The invention claimed is:

1. An indirectly heated rotary dryer, comprising:

a rotating shell, which is provided with a driven gear arranged around the rotating shell so that the driven gear is engaged with a drive gear and a rotational force of a motor is transmitted to the drive gear, which is rotated about a shaft center thereof by the rotational force of the motor, and which is capable of feeding of a material to be dried from one end side thereof and discharge of the dried material from the other end side thereof, a feed unit, which feeds the material to be dried into the rotating shell, a cylindrical center cover, which has the same shaft center of the rotating shell, which is arranged in the vicinity of the shaft center of the rotating shell, and which has a size corresponding to a seal portion to seal a clearance between the feed unit and the rotating shell, a plurality of partition walls, which are arranged respectively in the rotating shell in parallel to the shaft center of the rotating shell and structured to connect an outer circumferential face of the center cover and an inner circumferential face of the rotating shell so as to partition an inner space formed between the rotating shell and the center cover into a plurality of small spaces respectively extended along the shaft center of the rotating shell, and a plurality of heating tubes, which are arranged in each of the small spaces in parallel to the shaft center of the rotating shell for heating indirectly and drying the material to be dried by feeding heated steam to inner spaces of the heating tubes, wherein the partition walls are solid partition walls, the plurality of heating tubes are substantially located along concentric circles of same shaft center of the rotating shell, the heated steam is fed only to the inner spaces of the heating tubes, the material to be dried is supplied as being distributed into the respective small spaces, and the material to be dried is moved only within each of the small spaces, and the ratio of the outer diameter of the center cover with respect to the inner diameter of the rotating shell, the outer diameter of the center cover/the inner diameter of the rotating shell, is in a range between 0.2 and 0.6, wherein the plurality of heating tubes and the outer circumferential face of the center cover have the same annular concentricity.

2. The indirectly heated rotary dryer according to claim 1, wherein the center cover is extended to the vicinity of the feed unit, which feeds the material to be dried into the rotating shell, a screw-shaped blade, which reaches the inner circumferential face of the rotating shell, is arranged at the outer circumferential face of the extended center cover, and a cutout portion is formed so as to eliminate a portion of the center cover at a part where the screw-shaped blade is arranged.

3. The indirectly heated rotary dryer according to claim 1, wherein the heating tubes are arranged apart from the shaft center of the rotating shell by a length being 15% or more of a radius of the rotating shell as being in parallel to the shaft center of the rotating shell.

* * * * *